US010058750B2

(12) United States Patent
Weiss

(10) Patent No.: US 10,058,750 B2
(45) Date of Patent: Aug. 28, 2018

(54) COLLAPSIBLE GULF CLUB CARRIER

(71) Applicant: Austin Weiss, Ponte Vedra Beach, FL (US)

(72) Inventor: Austin Weiss, Ponte Vedra Beach, FL (US)

( * ) Notice: Subject to any disclaimer, the term of this patent is extended or adjusted under 35 U.S.C. 154(b) by 5 days.

(21) Appl. No.: 15/716,642

(22) Filed: Sep. 27, 2017

(65) Prior Publication Data

US 2018/0085646 A1 Mar. 29, 2018

Related U.S. Application Data

(60) Provisional application No. 62/400,212, filed on Sep. 27, 2016.

(51) Int. Cl.
*A63B 55/00* (2015.01)
*A63B 55/10* (2006.01)
*A45F 3/02* (2006.01)

(52) U.S. Cl.
CPC ..... *A63B 55/10* (2013.01); *A45F 3/02* (2013.01)

(58) Field of Classification Search
CPC ..... A63B 55/00; A63B 55/40; A63B 55/10
USPC ..... 211/79.2; 206/315.2
See application file for complete search history.

(56) References Cited

U.S. PATENT DOCUMENTS 1,418,093 A * 5/1922 Parmater ..... A63B 55/10 211/15
1,918,447 A * 7/1933 Blatz ..... A63B 55/00 206/315.5
2,419,175 A * 4/1947 Spohrer ..... A63B 55/10 211/70.2
2,465,096 A * 3/1949 Hunt ..... A63B 55/10 211/70.2
2,480,597 A * 8/1949 Nelson ..... B62B 1/14 211/70.2
2,533,541 A * 12/1950 Warring ..... B62B 1/262 211/70.2
2,791,255 A 5/1957 Ogden
2,990,865 A 7/1961 Steele
3,215,181 A 7/1965 Reed
3,415,572 A 12/1968 Zagwyn
3,483,996 A 12/1969 Scammon
3,866,646 A 2/1975 Nevard
4,154,274 A 5/1979 Adamson
4,747,490 A 5/1988 Smith
5,209,539 A 5/1993 Atalay
5,234,114 A 8/1993 Coffey
5,314,079 A 5/1994 Young
5,417,334 A 5/1995 Wu
5,474,191 A 12/1995 Bergeron et al.
5,492,384 A 2/1996 Tarko et al.
5,669,514 A 9/1997 Massetti
5,765,691 A * 6/1998 Hall ..... A63B 53/00 206/315.3
6,032,999 A 3/2000 York et al.
6,102,202 A * 8/2000 Jones ..... A63B 55/00 206/315.3

(Continued)

*Primary Examiner* — Sue A Weaver
(74) *Attorney, Agent, or Firm* — Thomas C. Saitta

(57) ABSTRACT

A golf club carrier having two main bodies joined by one or more telescoping connector members whereby the carrier may be longitudinally extended for transporting golf clubs or collapsed for storage, each of the main bodies having retainer members aligned in paired sets, each paired set adapted to receive and retain the shaft of a golf club.

20 Claims, 7 Drawing Sheets

(56) References Cited

U.S. PATENT DOCUMENTS

| | | | | |
|---|---|---|---|---|
| 6,216,864 | B1 * | 4/2001 | Chang | A63B 55/00 206/315.2 |
| 6,260,865 | B1 * | 7/2001 | Yacobi | B25H 3/04 248/346.01 |
| 6,471,055 | B1 | 10/2002 | Kwiecienski | |
| 8,066,119 | B2 | 11/2011 | Doman | |
| 8,287,399 | B2 | 10/2012 | Lacombe | |
| 9,038,821 | B2 * | 5/2015 | Proulx | A63B 47/002 206/315.2 |
| 2006/0163893 | A1 | 7/2006 | Gascoigne | |
| 2006/0185999 | A1 * | 8/2006 | Keays | A63B 55/00 206/315.3 |
| 2017/0021241 | A1 * | 1/2017 | Pelz | A63B 55/408 |

* cited by examiner

COLLAPSIBLE GULF CLUB CARRIER

This application claims the benefit of United States Provisional Patent Application Ser. No. 62/400,212, filed Sep. 27, 2016.

BACKGROUND OF THE INVENTION

This application relates generally to the field of carrier devices for golf clubs, and more particularly to such carriers adapted to retain a plurality of clubs, each club being retained in a dedicated retention system such that any individual retained club may be removed from and resecured in the carrier without affecting the remaining clubs. This invention further relates to such carriers designed to carry less than a full set of clubs, and to such carriers that may be reduced in size when not in use.

The game of golf requires the use of a plurality of individual golf clubs each club differing from the other clubs in terms of structure and purpose (e.g., putter vs. iron vs. driver) and/or design specifications (e.g., differing lofts for each iron). The typical golf club carrier is a golf bag, a generally cylindrical, open-topped container into which all of the golf clubs are inserted shaft-first, the heads of the golf clubs extending from the top of the bag. Some bags provided dividers or tubes to separate the golf clubs. Some are designed to be lightweight for the golfer to carry, while heavier golf bags are meant to transported on the back of a golf cart.

When playing on a full size golf course, a golfer will bring 14 clubs, the maximum number set forth in the rules of golf, or possibly one or two more or less when playing a non-tournament round. There are times however when a golfer may not need the full complement of clubs, such as for example when practicing on a driving range or playing a par 3 course. In these circumstances a golfer may only need a small number of clubs, in which case carrying a full-size bag with unwanted clubs is burdensome.

Non-bag-type golf club carriers are known, such as U.S. Patent Publ. No. 2006/0163893 to Gascoigne, U.S. Pat. No. 8,287,399 to LaCombe, U.S. Pat. No. 6,032,999 to York et al., U.S. Pat. No. 5,669,514 to Massetti, U.S. Pat. No. 5,492,384 to Tarko et al., U.S. Pat. No. 5,417,334 to Wu, U.S. Pat. No. 5,234,114 to Coffey, U.S. Pat. No. 5,209,539 to Atalay, U.S. Pat. No. 3,483,996 to Scammon. U.S. Pat. No. 3,215,181 to Reed, and U.S. Pat. No. 2,990,865 to Steele. These known carriers, however, are not optimally structured, as many consist of separate components when disassembled, have relatively fragile or flimsy assemblies, and clumsy in design and functionality.

It is an object of this invention to provide a golf club carrier adapted and structured to retain a number of clubs less than a full set, such as for example six to eight clubs, the carrier having a light weight structure, which improves upon the earlier known devices in a novel and non-obvious manner. It is a further object to provide such a carrier wherein each club is individually retained for easy removal from and return to the carrier without affecting the remaining clubs. It is a further object to provide such a carrier that is reducible in size when not in use, wherein the carrier collapses in telescoping manner and remains a unitary device rather than being separable into disassembled components.

SUMMARY OF THE INVENTION

In general, the invention is golf club carrier device designed and structured to carry less than the normal full complement of fourteen golf clubs, such as a total of six or eight clubs for example. The carrier is structured such that each club may be individually removed from the carrier and replaced after use without interference from or interfering with other clubs residing in the carrier, the club retention system or mechanism being of a relatively simple structure and functionality such that a club is simply and easily pressed into the retention mechanism and then simply and easily pulled from the retention mechanism, the retention mechanism securing the golf dub shaft in a friction-fit or press-fit manner without the need for manipulation of any multi-component mechanical fastening structures or assemblies (e.g., hinges, snaps, hook-and-loop straps, etc.) by the user. The carrier is structured to be collapsible from an extended in-use state, as shown in FIGS. 1-6, to a collapsed non-use state, as shown in FIGS. 8-11, for easier storage or transport.

Alternatively summarized, the invention is a collapsible golf club carrier comprising a first main body and a second main body, said first and second main bodies connected to each other in telescoping manner; at least one telescoping connector member extending between said first and second main bodies, whereby said telescoping connector member is collapsible to a collapsed state to bring said first and second main bodies toward each other and expandable to an expanded state to separate said first and second main bodies; and a plurality of shaft retainer members disposed on said first main body and an equal number of shaft retainer members disposed on said second main body, each of said shaft retainer members of said first and second main bodies being adapted to releasably retain a golf club shaft. Furthermore, the invention wherein at least one of said first and said second main bodies comprises at least one connector recess adapted to receive said at least one telescoping connector member when said at least one telescoping connector member is in the collapsed state; wherein each of said plurality of shaft retainer members of said first and second main bodies is composed of a compressible material; wherein each of said plurality of shaft retainer members of said first and second main bodies is composed of a resilient material; wherein said plurality of shaft retainer members of said first and second main bodies are arranged in pairs such that each pair is adapted to receive a single golf club shaft; wherein said at least one telescoping connector member defines a longitudinal axis, and further wherein each of said pairs of shaft retainer members of said first and second main bodies are aligned to receive a single golf club shaft such that the golf club shaft is aligned parallel to said longitudinal axis of said at least one telescoping connector member; each of said first and second main bodies comprising a plurality of notches, such that each of said shaft retainer members of said first and second main bodies is positioned within one of said notches; and/or wherein each of said plurality of shaft retainer members of said first and second main bodies comprises a bore and a neck, wherein the width of said neck is less than the width of said bore.

In other terms, the invention is a collapsible golf club carrier comprising a first main body and a second main body, said first and second main bodies connected to each other in telescoping manner; at least one telescoping connector member extending between said first and second main bodies, whereby said telescoping connector member is collapsible to a collapsed state to bring said first and second main bodies toward each other and is expandable to an expanded state to separate said first and second main bodies, said at least one telescoping connector member defining a longitudinal axis; at least one connector recess disposed in at least one of said first and second main bodies, said connector recess adapted to receive said at least one telescoping connector member when said at least one telescoping connector member is in the collapsed state; a plurality of shaft retainer members disposed on said first main body and an equal number of shaft retainer members disposed on said second main body, each of said shaft retainer members of said first and second main bodies being adapted to releasably retain a golf club shaft, wherein said plurality of shaft retainer members of said first and second main bodies are arranged in pairs such that each pair is aligned to receive a single golf club shaft such that the golf club shaft is aligned in parallel to the longitudinal axis of said at least one telescoping connector member. Furthermore, wherein each of said plurality of shaft retainer members of said first and second main bodies is composed of a compressible or resilient material; wherein each of said plurality of shaft retainer members of said first and second main bodies comprises a bore and a neck, wherein the width of said neck is less than the width of said bore; and/or each of said first and second main bodies comprising a plurality of notches, such that each of said shaft retainer members of said first and second main bodies is positioned within one of said notches.

DETAILED DESCRIPTION OF THE INVENTION

In general, the invention is golf club carrier device designed and structured to carry less than the normal full complement of fourteen golf clubs, such as a total of six or eight clubs for example. The carrier is structured such that each club may be individually removed from the carrier and replaced after use without interference from or interfering with other clubs residing in the carrier, the club retention system or mechanism being of a relatively simple structure and functionality such that a club is simply and easily pressed into the retention mechanism and then simply and easily pulled from the retention mechanism, the retention mechanism securing the golf club shaft in a friction-fit or press-fit manner without the need for manipulation of any multi-component mechanical fastening structures or assemblies (e.g., hinges, snaps, hook-and-loop straps, etc.) by the user. The carrier is structured to be collapsible from an extended in-use state, as shown in FIGS. 1-6, to a collapsed non-use state, as shown in FIGS. 8-11, for easier storage or transport.

The collapsible golf club carrier comprises a pair or set of main bodies, a first main body or housing 10 and a second main body 20. In a preferred embodiment, each main body 10/20 is generally triangular in shape, wherein the bottom of each main body 10/20 is wider than the top. Preferably one or more leg or foot members 60 extend beneath err are incorporated into each main body 10/20 to support the carrier when it is placed on the ground or other surface.

Figure 1:
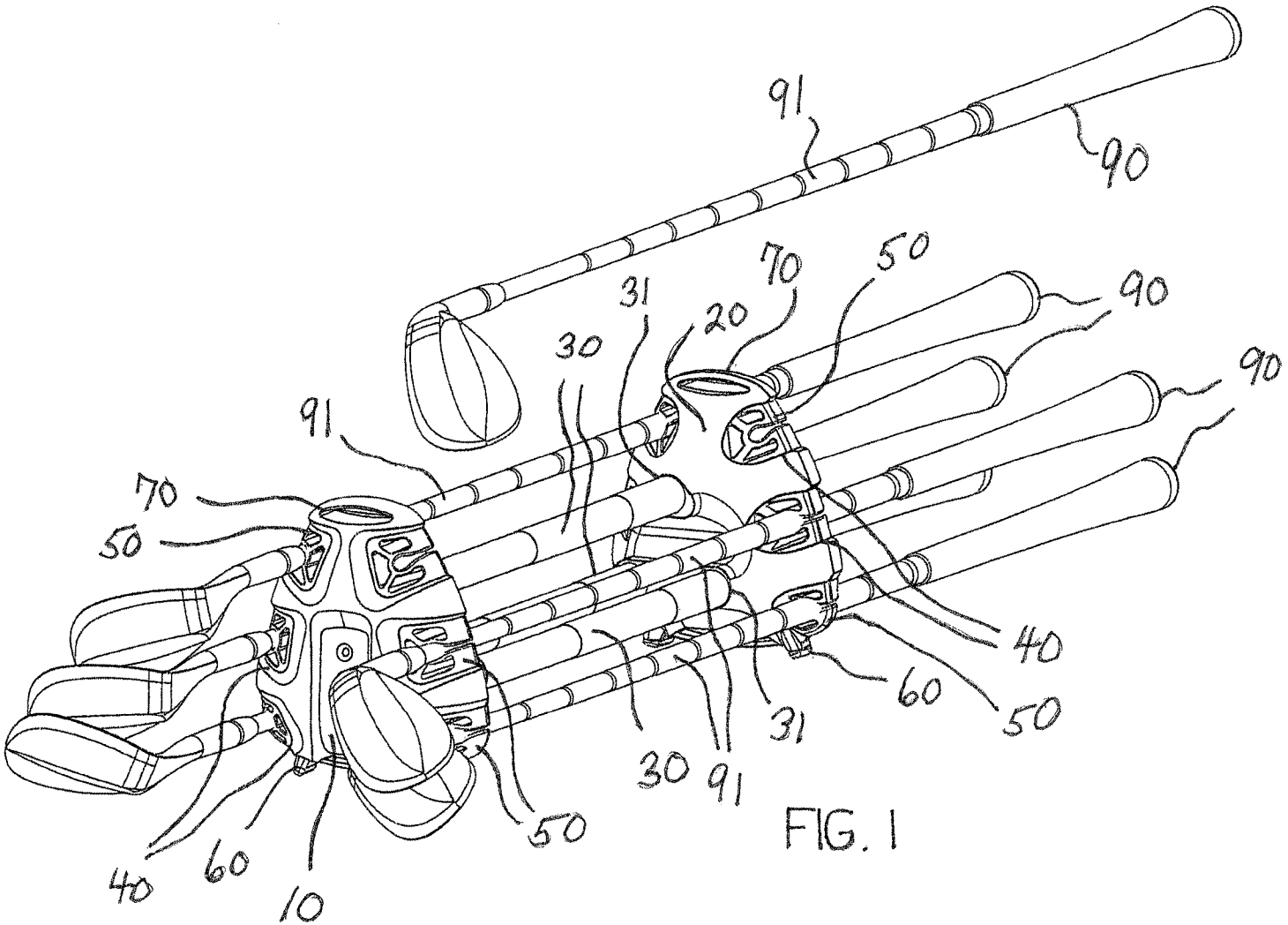
FIG. 1 is a perspective view of an embodiment of the invention shown retaining a plurality of golf clubs, with one club removed for clarity.
Figure 2:
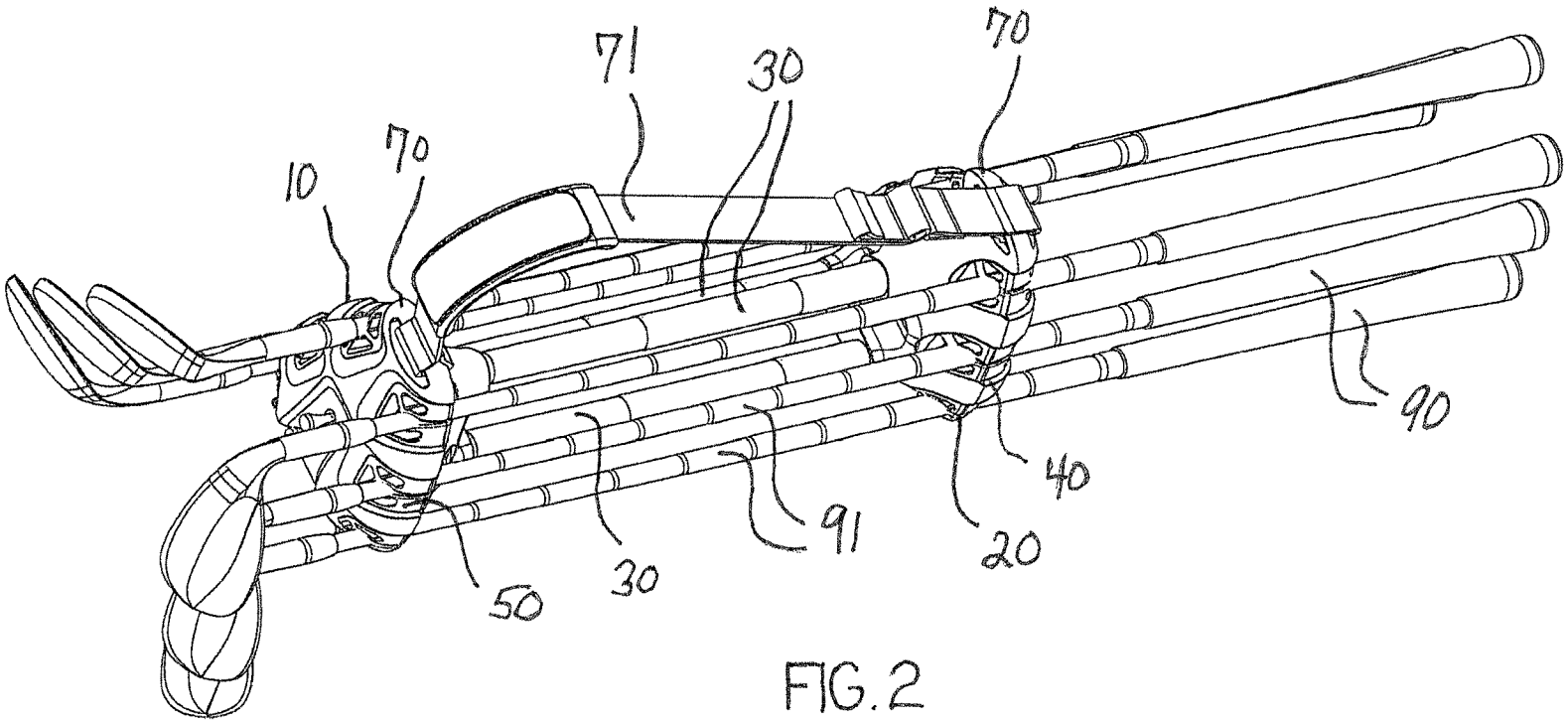
FIG. 2 is a perspective view of the embodiment of FIG. 1 showing a connected shoulder strap.
Figure 3:
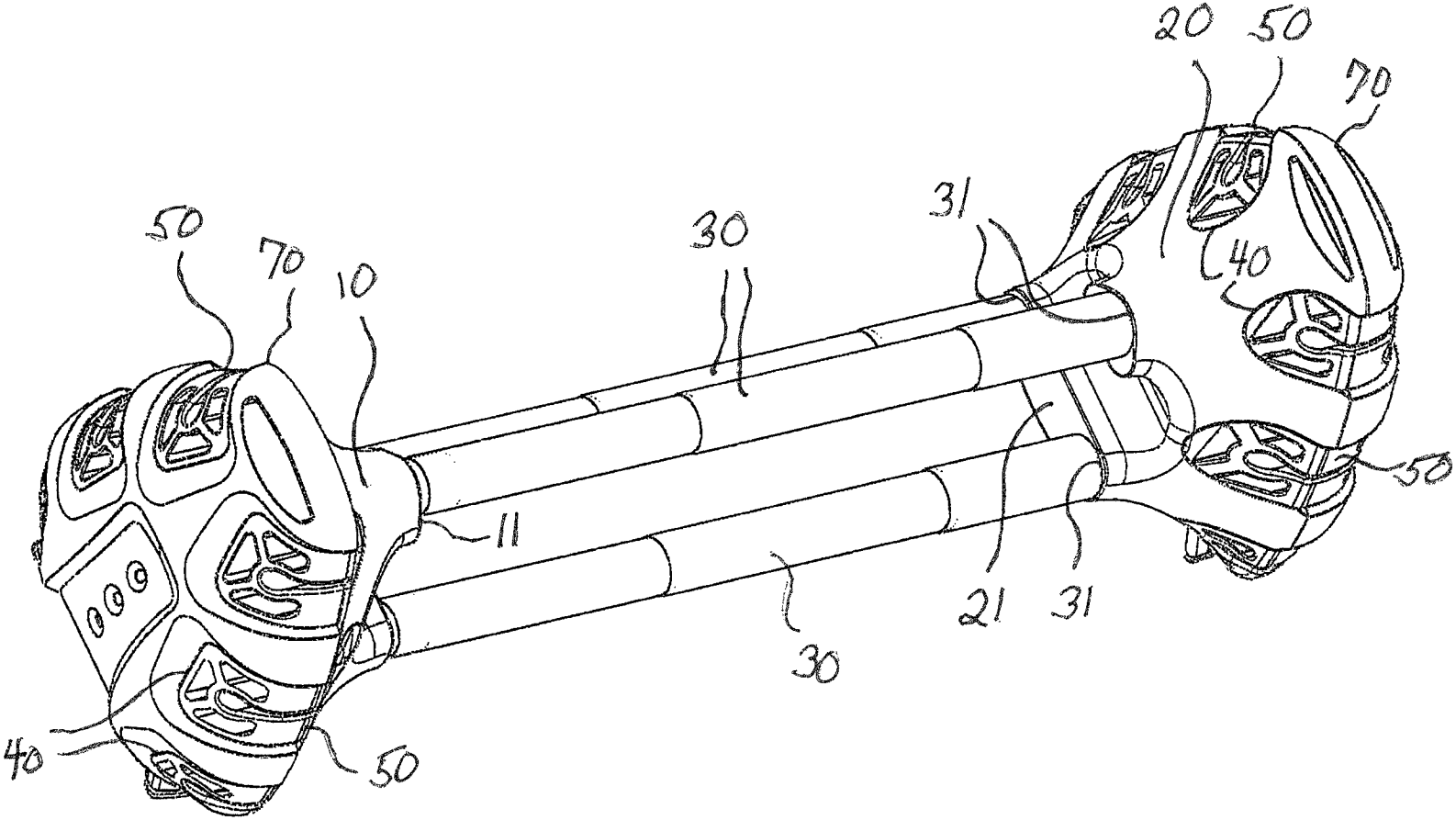
FIG. 3 is a perspective view of the embodiment of FIG. 1 shown without golf clubs.
Figure 4:
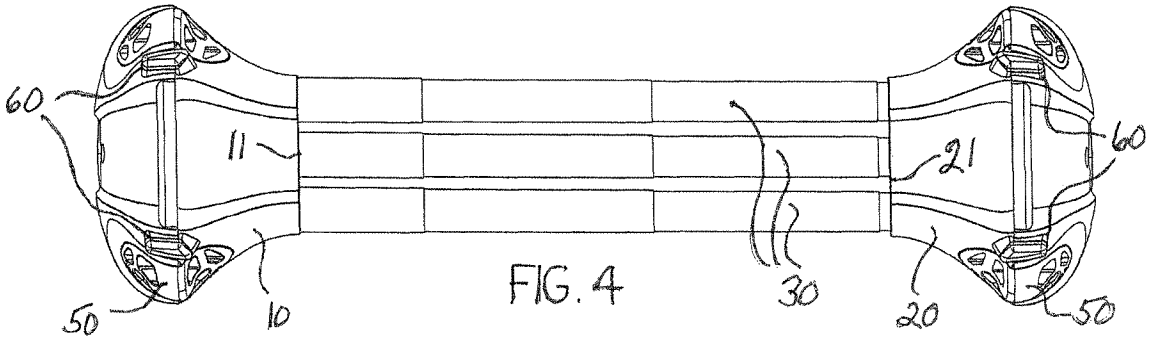
FIG. 4 is a bottom view of the embodiment of FIG. 3.
Figure 5:
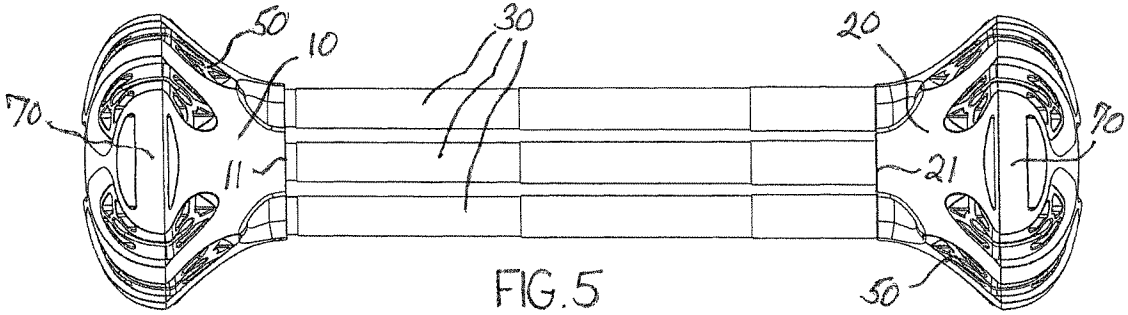
FIG. 5 is a top view of the embodiment of FIG. 3.
Figure 6:
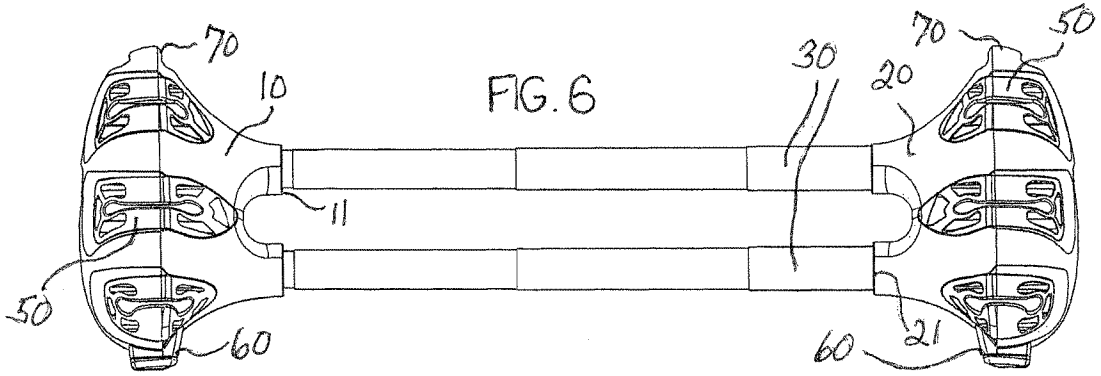
FIG. 6 is a side view of the embodiment of FIG. 3.

Preferably uric or more handle members extend upwardly from or are incorporated into the top of each main body 10/20, the handle members 70 adapted to be grasped by the user to carry the golf club carrier, each handle member 70 comprising for example a generally horizontal slot sized to receive the user's fingers. Preferably a strap member 71, which may be adjustable in length, is mounted permanently or removably to the handle members 70 or other portions of the main bodies 10/20 so as to extend between the first main body 10 and the second main body 20. Dedicated mounting mechanisms may be provided on the main bodies 10/20, such as rings or clips, or more preferably the strap member 71 may be connected to or through the handle members 70, as shown in FIG. 2.

The two main bodies 10/20 are connected to each other by one or more rigid telescoping connector members 30. The telescoping connector members 30 comprise segments that are coaxially arranged in known manner such that the segments may be axially extended to elongate the telescoping connecting member 30 or collapsed such that the segments are nested to shorten the telescoping connector member 30. Each of the telescoping connector members 30 when collapsed is received in a corresponding connector recess 31 that extends internally within at least one of the main bodies 10/20. The connector recesses 31 and the telescoping connector members 30 are sized such that two main bodies 10/20 may be brought together to abut or nearly abut each other by collapsing, the telescoping connector members 30, main body 10 having an abutment or facing surface 11 and main body 20 having an abutment or facing surface 21. Thus, when not in use the golf club carrier may be collapsed into a smaller configuration by moving the two main bodies 10/20 together such that the segments of the telescoping connector members 30 nest coaxially and recede into the connector recesses 31 of one or both of the main bodies 10/20 such that abutment surfaces 11/21 are facing or in contact, as shown in FIGS. 7-11. To use the carrier, the main bodies 10/20 are separated such that the telescoping connector members 30 are pulled from the connector recesses 31 into the fully extended state.

A plurality of corresponding notches or recesses 40 are provided in the sides of each main body 10/20, the number, positioning and alignment of the notches 40 being the same for both main bodies 10/20. For example, as shown in the figures, each main body 10/20 may be provided with a total of six notches, three notches 40 being disposed on each side of main body 10 and three notches 40 being disposed on each side of main body 20. The notches 40 are arranged in paired sets with one paired notch 40 being on main body 10 and the corresponding paired notch 40 being on main body 20, each paired set of notches 40 defining a linear axis generally parallel to the longitudinal axes defined by the telescoping connector members 30, whereby a golf club shaft 91 may be positioned in a paired set of notches 40 and will be aligned parallel to the longitudinal axis defined by the telescoping connector members 30.

Figure 7:
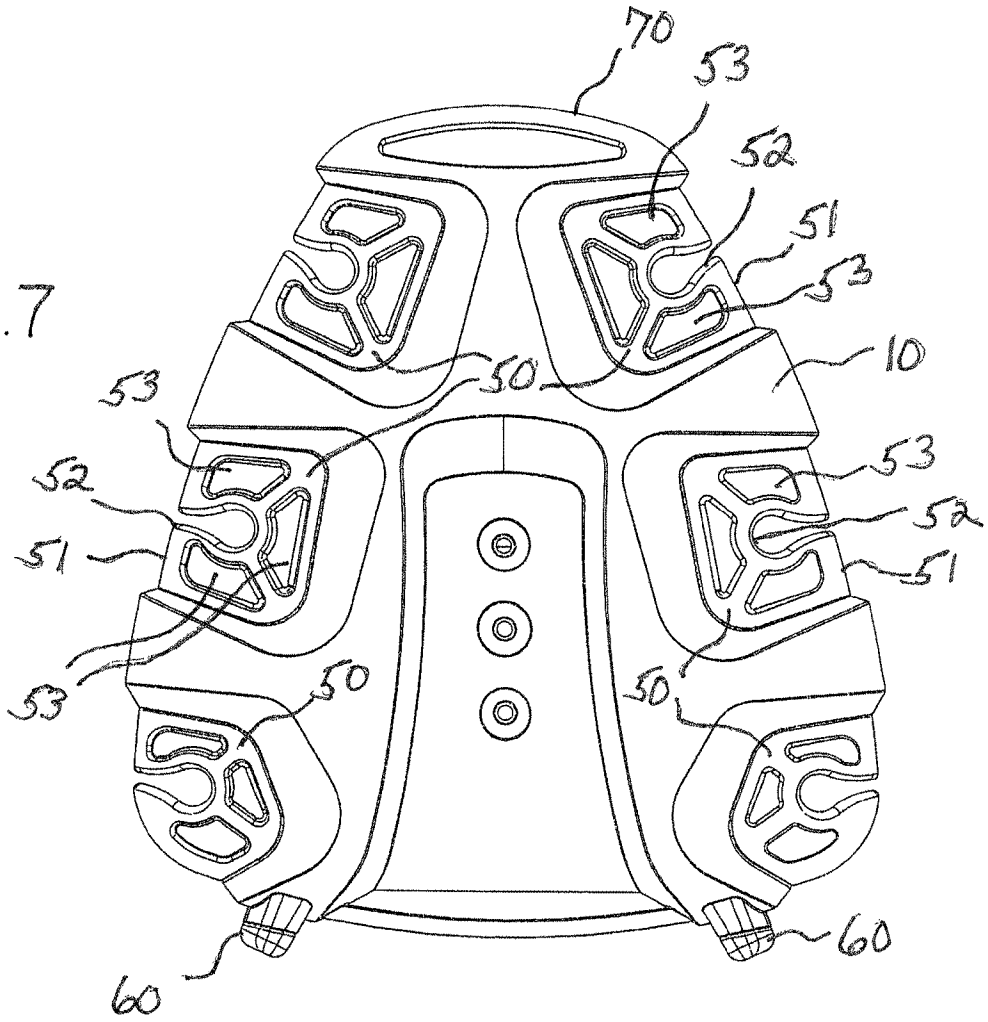
FIG. 7 is a front view of the embodiment of FIG. 3.
Figure 8:
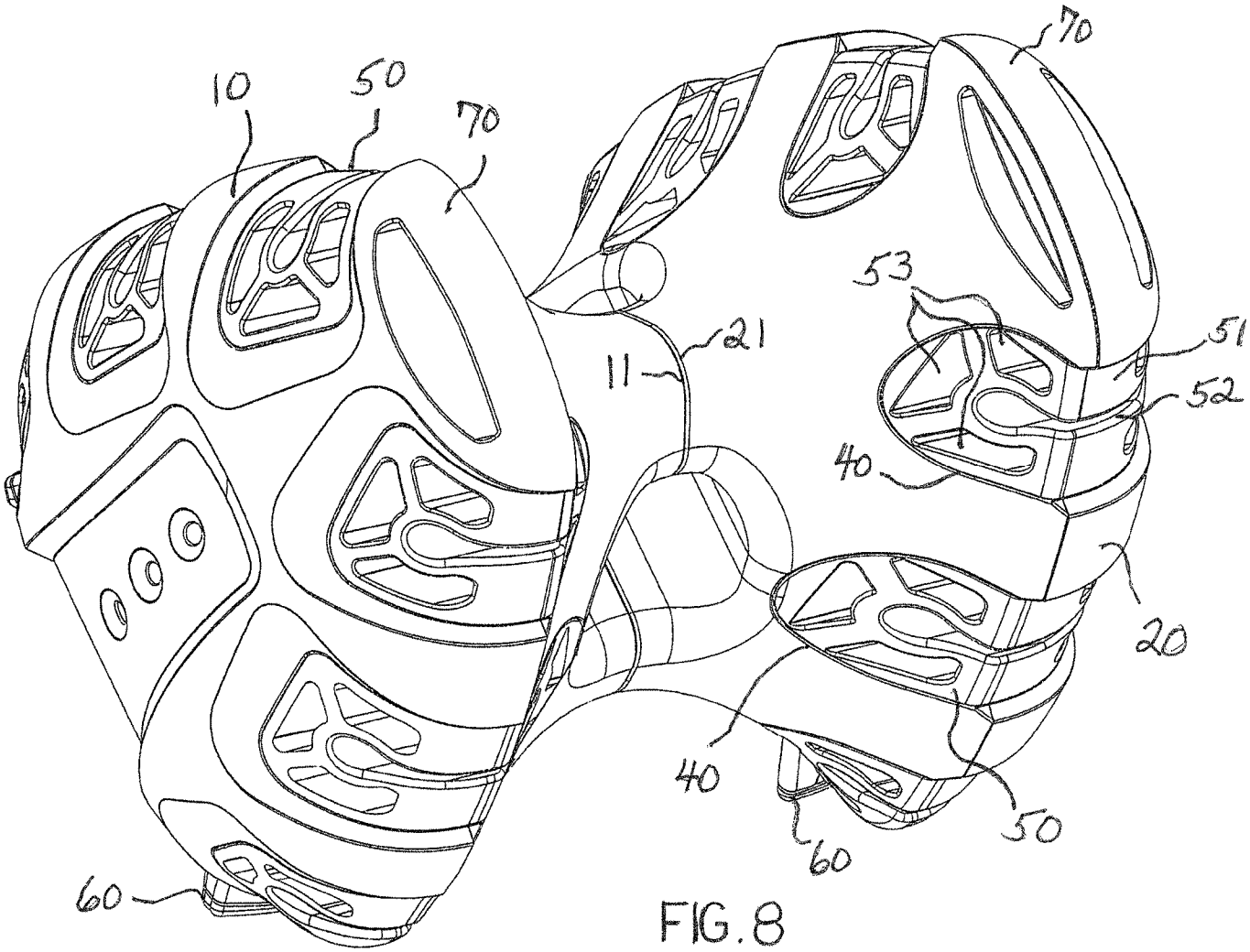
FIG. 8 is a perspective view of the embodiment of FIG. 3 shown in the collapsed state.
Figure 9:
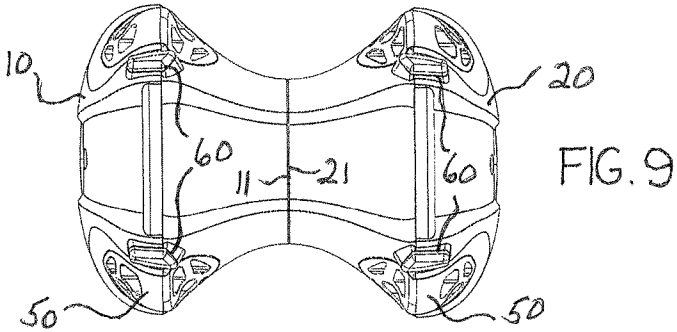
FIG. 9 is a bottom view of the embodiment of FIG. 8.
Figure 10:
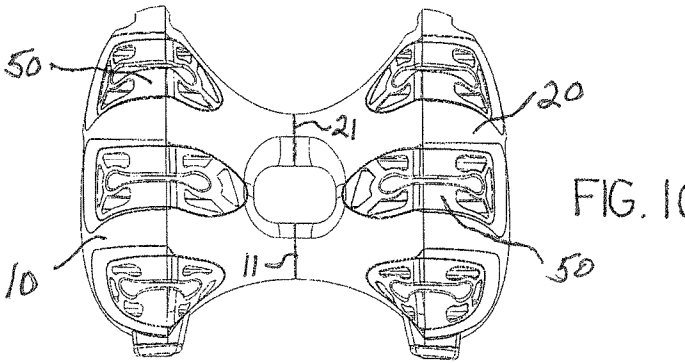
FIG. 10 is a side view of the embodiment of FIG. 8.
Figure 11:
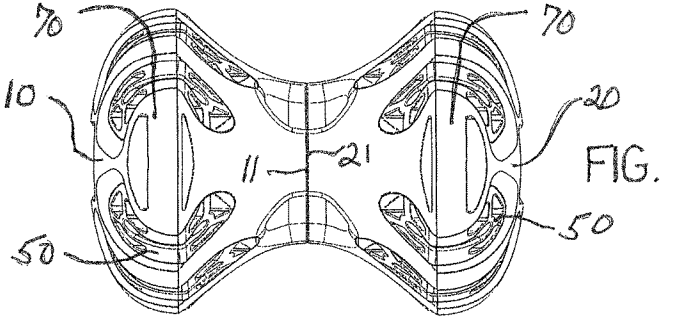
FIG. 11 is a side view of the embodiment of FIG. 8.

Each of the notches 40 is structured and adapted to receive and retain a resilient and preferably compressible golf club shaft retainer member 50, as seen in FIG. 7. In this manner the number, positioning and alignment of the shaft retainer members 50 will be the same for both main bodies 10/12, and the shaft retainer members 50 will be positioned in sets or pairs each to receive a golf club shaft 91, with the golf club shaft 91 aligned parallel to the longitudinal axis defined by the telescoping connector members 30.

Each of the shaft retainer members 50 is provided with a slot 52 sized to receive therein the shaft 91 of a golf club 90, the slot 52 extending inwardly from the outer edge 51 of each shaft retainer member 50. The slot 52 comprises a bore 55 and a neck 54, the neck 54 having a width less than the width of the bore 55, and both the bore 55 and the neck 54 having a width less than the smallest typical diameter of a golf club shaft 91. The shaft retainer members 50 may be provided with apertures or openings 53 to improve resilience or compressibility, or to remove material for cost or weight benefits. The shaft retainer members 50 may be composed of a relatively hard polymer material structured in a flexible configuration in the nature of a clip, such that the sides of the neck 54 of the shaft retainer member 50 are forced apart when a golf club shaft 91 is pushed into slot 52, the neck 54 and shaft retainer member 50 then snapping back to the original non-stressed configuration as the club shaft 91 is further inserted into the bore 55 so as to partially surround and retain the shaft 91. Pulling the shaft 91 outwardly to remove the club 90 from the carrier widens or spreads open the neck 54 of the slot 52 for release of the club 90 from the carrier.

Most preferably however, the shaft retainer members 50 are composed of a resilient, compressible material, such as a polymer foam or rubber material, such that the material to either side of the slot 52 compresses when a golf club shaft 91 is inserted into the neck 54 of slot 52 and then rebounds as the shaft 91 is pushed into the bore 55 of slot 52, thereby retaining the shaft 91 within the shaft retainer member 50 in a snug or friction-fit manner. The body of the shaft retainer members 50 may be provided with apertures or openings 53 to provide for easier compression. To remove the club 90 from the carrier the shaft 91 is pulled outwardly, which compresses the material and widens the neck 54 of the slot 52 so that the shaft 91 is no longer restrained and is easily released.

With this structure, the shaft 91 of a golf club 90 retained by the carrier will extend between one of the paired sets of shaft retainer members 50, with the shafts 91 of multiple clubs 90 being aligned generally parallel to the longitudinal axes of the telescoping connector members 30 and with all the golf club shafts 91 aligned generally in parallel to each other. Each club 90 may be individually removed and replaced without contacting or disturbing the remaining clubs 90.

It is understood that equivalents and substitutions for certain elements and structure set forth above may be obvious to those of ordinary skill in the art, and therefore the true scope and definition of the invention is to be as set forth in the following claims.

I claim:

1. A collapsible golf club carrier comprising:

a first main body and a second main body, said first and second main bodies connected to each other in telescoping manner;

one or more telescoping connector member extending between said first and second main bodies, whereby each of said one or more telescoping connector members is collapsible to a collapsed state to bring said first and second main bodies toward each other and expandable to an expanded state to separate said first and second main bodies; and a plurality of shaft retainer members disposed on said first main body and an equal number of shaft retainer members disposed on said second main body, each of said shaft retainer members of said first and second main bodies being adapted to releasably retain a golf club shaft;

wherein at least one of said first and said second main bodies comprises one or more connector recesses each adapted to receive one of said one or more telescoping connector members therein, such that each of said one or more telescoping connector members is entirely disposed within one of said one or more connector recesses when said one or more telescoping connector members are in each in a fully collapsed state.

2. The carrier of claim 1, wherein each of said plurality of shaft retainer members of said first and second main bodies is composed of a compressible material.

3. The carrier of claim 1, wherein each of said plurality of shaft retainer members of said first and second main bodies is composed of a resilient material.

4. The carrier of claim 1, each of said first and second main bodies comprising a plurality of notches, such that each of said shaft retainer members of said first and second main bodies is positioned within one of said notches.

5. The carrier of claim 1, wherein each of said plurality of shaft retainer members of said first and second main bodies comprises a bore and a neck, wherein the width of said neck is less than the width of said bore.

6. The carrier of claim 1, such that with each of said one or more telescoping connectors members in the fully collapsed state, said first and second main bodies are disposed adjacent to each other.

7. The carrier of claim 6, wherein one or more connector recesses are disposed in said first main body and one or more connector recesses are disposed in said second main body.

8. The carrier of claim 1, such that with each of said one or more telescoping connectors members in the fully collapsed state, said first and second main bodies are disposed in contact with each other.

9. The carrier of claim 8, wherein one or more connector recesses are disposed in said first main body and one or more connector recesses are disposed in said second main body.

10. The carrier of claim 1, wherein one or more connector recesses are disposed in said first main body and one or more connector recesses are disposed in said second main body.

11. A collapsible golf club carrier comprising:

a first main body and a second main body, said first and second main bodies connected to each other in telescoping manner;

one or more telescoping connector member extending between said first and second main bodies, whereby each of said one or more telescoping connector members is collapsible to a collapsed state to bring said first and second main bodies toward each other and is expandable to an expanded state to separate said first and second main bodies, said at least one telescoping connector member defining a longitudinal axis;

one or more connector recesses disposed in at least one of said first and second main bodies, each of said connector recesses adapted to entirely receive one of said one or more telescoping connector members therein when each of said one or telescoping connector members is in a fully collapsed state; and a plurality of shaft retainer members disposed on said first main body and an equal number of shaft retainer members disposed on said second main body, each of said shaft retainer members of said first and second main bodies being adapted to releasably retain a golf club shaft, wherein said plurality of shaft retainer members of said first and second main bodies are arranged in pairs such that each pair is aligned to receive a single golf club shaft such that the golf club shaft is aligned in parallel to the longitudinal axis of one of said one or more telescoping connector member.

12. The carrier of claim 11, wherein each of said plurality of shaft retainer members of said first and second main bodies is composed of a compressible or resilient material.

13. The carrier of claim 12, wherein each of said plurality of shaft retainer members of said first and second main bodies comprises a bore and a neck, wherein the width of said neck is less than the width of said bore.

14. The carrier of claim 11, wherein each of said plurality of shaft retainer members of said first and second main bodies comprises a bore and a neck, wherein the width of said neck is less than the width of said bore.

15. The carrier of claim 11, each of said first and second main bodies comprising a plurality of notches, such that each of said shaft retainer members of said first and second main bodies is positioned within one of said notches.

16. The carrier of claim 11, such that with each of said one or more telescoping connectors members in the fully collapsed state, said first and second main bodies are disposed adjacent to each other.

17. The carrier of claim 16, wherein one or more connector recesses are disposed in said first main body and one or more connector recesses are disposed in said second main body.

18. The carrier of claim 11, such that with each of said one or more telescoping connectors members in the fully collapsed state, said first and second main bodies are disposed in contact with each other.

19. The carrier of claim 18, wherein one or more connector recesses are disposed in said first main body and one or more connector recesses are disposed in said second main body.

20. The carrier of claim 11, wherein one or more connector recesses are disposed in said first main body and one or more connector recesses are disposed in said second main body.

* * * * *